US008729413B2

(12) United States Patent
Nakaoka et al.

(10) Patent No.: US 8,729,413 B2
(45) Date of Patent: May 20, 2014

(54) PUSH SWITCH AND METHOD FOR MANUFACTURING THE SAME

(75) Inventors: Yusuke Nakaoka, Okayama (JP); Masatsugu Takeuchi, Okayama (JP)

(73) Assignee: Panasonic Corporation, Osaka (JP)

( * ) Notice: Subject to any disclaimer, the term of this patent is extended or adjusted under 35 U.S.C. 154(b) by 195 days.

(21) Appl. No.: 13/206,905

(22) Filed: Aug. 10, 2011

(65) Prior Publication Data

US 2012/0055773 A1 Mar. 8, 2012

(30) Foreign Application Priority Data

Sep. 7, 2010 (JP) ..... 2010-199622

(51) Int. Cl.
*H01H 1/10* (2006.01)

(52) U.S. Cl.
USPC ..... 200/512

(58) Field of Classification Search
USPC ..... 200/406, 512, 513
IPC ..... H01H 13/7006,13/704, 13/705
See application file for complete search history.

(56) References Cited

U.S. PATENT DOCUMENTS

| | | | | |
|---|---|---|---|---|
| 4,286,129 | A * | 8/1981 | Petit | 200/513 |
| 6,610,950 | B1 * | 8/2003 | Kamio et al. | 200/406 |
| 6,743,994 | B2 * | 6/2004 | Adachi | 200/512 |
| 6,946,610 | B2 * | 9/2005 | Takeuchi et al. | 200/406 |
| 7,057,128 | B1 * | 6/2006 | Oyagi et al. | 200/406 |
| 7,129,435 | B2 * | 10/2006 | Sano | 200/512 |
| 2007/0235312 | A1 | 10/2007 | Takeuchi | |
| 2009/0073724 | A1 * | 3/2009 | Hayama et al. | 362/620 |
| 2011/0162949 | A1 * | 7/2011 | Dimig | 200/505 |

FOREIGN PATENT DOCUMENTS

| | | | |
|---|---|---|---|
| CN | 1327605 | A | 12/2001 |
| CN | 101051572 | A | 10/2007 |
| CN | 201110262934.9 | | 10/2013 |
| JP | 2006-344511 | A | 12/2006 |
| JP | 2010-135151 | | 6/2010 |

* cited by examiner

*Primary Examiner* — Vanessa Girardi
(74) *Attorney, Agent, or Firm* — RatnerPrestia

(57) ABSTRACT

A push switch includes a case having a recess portion, a first fixed contact placed in the recess portion, and a second fixed contact placed in the recess portion. Furthermore, the push switch includes a dome-shaped movable contact placed in the recess portion and having a center portion facing the first fixed contact with a space therebetween, a protective sheet for covering the recess portion, and a protrusion member fixed to the protective sheet by welding at a convex side of the center portion of the movable contact. The first fixed contact and the second fixed contact are provided at positions that are brought into contact with the movable contact when the movable contact is elastically reversed.

11 Claims, 3 Drawing Sheets

PUSH SWITCH AND METHOD FOR MANUFACTURING THE SAME

BACKGROUND OF THE INVENTION

1. Field of the Invention

The present invention relates to a push switch used in input operation sections of various electronic apparatuses and a method for manufacturing the same.

2. Background Art

Recently, a push switch having a protrusion portion in the operation part thereof has been mounted in various electronic apparatuses. FIG. 5 is a sectional view of a conventional push switch. FIG. 6 is an external perspective view of the conventional push switch.

Case 1 has a recess portion that opens on the top surface and is formed of resin. On the inner bottom surface of the recess portion of case 1, center contact 2 and outer contacts 4 are fixed. Center contact 2 is connected to first terminal 2A led out from case 1, and outer contact 4 is connected to second terminal 4A led out from case 1. Movable contact 5 formed of a metal thin plate and having a circular dome shape projecting upward in the center thereof is accommodated in the recess portion of case 1.

Protective sheet 7 is formed of an insulating film such as a polyimide film having adhesive agent 8 on the entire lower surface. Protective sheet 7 is attached to the upper end of case 1 with adhesive agent 8 so as to cover the recess portion of case 1.

Operating protrusion portion 10 is provided in a part corresponding to the center position of movable contact 5. The corresponding part of protective sheet 7 is plastically deformed into an upwardly convex shape, and accommodating member 11 processed to be formed in a columnar shape is pushed into from the lower surface side of protective sheet 7. Thus, protrusion portion 10 is formed.

The top surface portion and peripheral portion of accommodating member 11 are adhesively fixed to protective sheet 7 with adhesive agent 8.

Next, an operation of the conventional push switch is described. When a user operates to depress an operation button (not shown) at an electronic apparatus side, protrusion portion 10 is depressed by the lower surface of the operation button, and force is applied to movable contact 5 via protrusion portion 10. When the force exceeds a predetermined size, the center portion of movable contact 5 is reversed with a click feeling, and the lower surface of the center portion of movable contact 5 is brought into contact with center contact 2. Consequently, center contact 2 and outer contacts 4 are electrically connected to each other via movable contact 5, thus bringing terminal 2A and terminal 4A into electrical conduction. When the force is removed, movable contact 5 returns by itself to the original shape by resilient force of itself, and terminal 2A and terminal 4A return to a state before the operation in which they are electrically independent from each other.

In a conventional push switch, accommodating member 11 of protrusion portion 10 is adhesively attached to protective sheet 7 with adhesive agent 8. Therefore, when a pressing operation is repeated, the adhesive strength is weakened, and protective sheet 7 and accommodating member 11 may be peeled off from each other. Furthermore, after the recess portion is formed by plastically deforming protective sheet 7 such that it corresponds to the outer shape of accommodating member 11, accommodating member 11 is inserted into the recess portion.

In order to improve the adhesive strength of accommodating member 11, it is important to insert accommodating member 11 into the recess portion of protective sheet 7 without a gap. In order to do so, high accuracy of protective sheet 7 is required in manufacturing. Therefore, it is necessary to finely adjust pressing conditions such as temperature and time when the recess portion of protective sheet 7 is formed.

SUMMARY OF THE INVENTION

A push switch includes a case having a recess portion, a first fixed contact placed in the recess portion, and a second fixed contact placed in the recess portion. Furthermore, the push switch includes a dome-shaped movable contact placed in the recess portion and having a center portion facing the first fixed contact with a space therebetween, a protective sheet for covering the recess portion, and a protrusion member fixed to the protective sheet by welding at a convex side of the center portion of the movable contact. The first fixed contact and the second fixed contact are provided in positions that are brought into contact with the movable contact when the movable contact is elastically reversed.

A method for manufacturing a push switch includes placing a first fixed contact in a recess portion of a case, placing a second fixed contact in the recess portion, placing a dome-shaped movable contact having a center portion facing the first fixed contact with a space therebetween in the recess portion, placing a protective sheet so as to cover the recess portion, and fixing a protrusion member to the protective sheet by welding at a convex side of the center portion of the movable contact.

DETAILED DESCRIPTION OF THE INVENTION

First Embodiment

Figure 1:
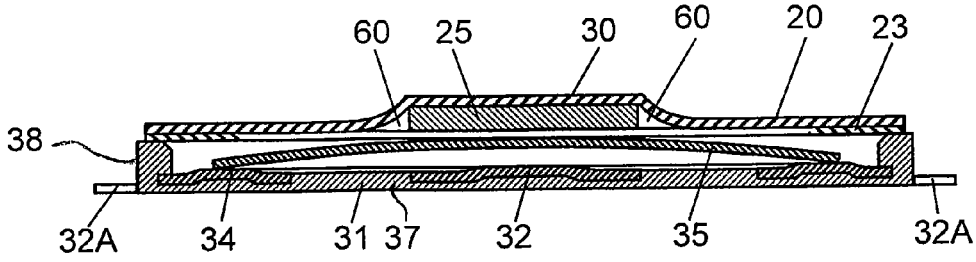
FIG. 1 is a sectional view of a push switch in accordance with a first embodiment of the present invention.
Figure 2:
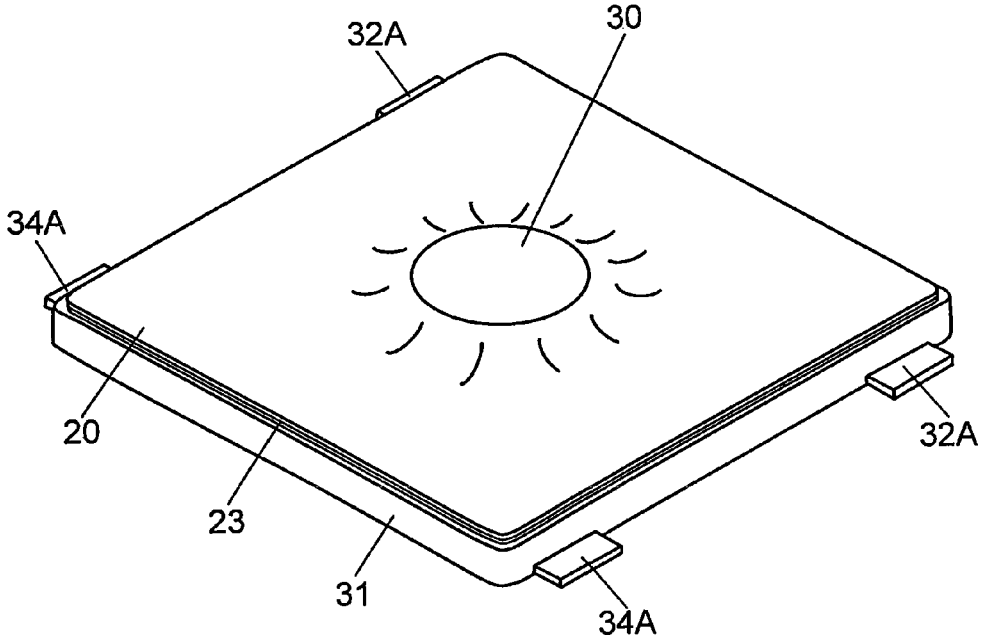
FIG. 2 is an external perspective view of the push switch in accordance with the first embodiment of the present invention.

FIG. 1 is a sectional view of a push switch in accordance with a first embodiment of the present invention. FIG. 2 is an external perspective view of the push switch in accordance with this embodiment.

A push switch includes case 31 having a bottom 37 and an outer wall 38 surrounding the bottom to form a recess portion, center contact 32 (first fixed contact) placed in the recess portion, and outer contact 34 (second fixed contact) placed in the recess portion. Furthermore, the push switch includes dome-shaped movable contact 35 placed in the recess portion and having a center part facing center contact 32 with a space therebetween, protective sheet 20 for covering the recess portion, and protrusion member 25 fixed to protective sheet 20 by welding at a convex side of the center portion of movable contact 35.

Case 31 has the recess portion that opens on the top surface, and is formed of resin in a rectangular shape. On the inner bottom surface of the recess portion of case 31, center contact 32 and outer contacts 34 are fixed by insert molding.

Center contact 32 is connected to first terminal 32A led out from case 31, and outer contact 34 is connected to second terminal 34A led out from case 31. The lower end of the outer periphery of movable contact 35 is put on outer contact 34 and accommodated in the recess portion. The lower surface of the center portion of movable contact 35 faces center contact 32 with a predetermined space maintained therebetween.

Protective sheet 20 made of an insulating film is attached to the upper end of case 31 with adhesive layer 23 and covers the recess portion of case 31. On the lower surface of protective sheet 20, operating protrusion member 25 processed to be formed of resin in a columnar shape is fixed by welding with respect to the center position of movable contact 35. For protective sheet 20 and protrusion member 25, nylon is used. As the welding method, laser welding or ultrasonic welding is employed. As the welding method, a method in which an interface portion between protective sheet 20 and protrusion member 25 is melted, and they are mixed and welded can be employed. For the material and color of protective sheet 20 and protrusion member 25, those suitable for each welding method can be appropriately selected.

In the case of, for example, laser welding, one member of protective sheet 20 and protrusion member 25 is made to be transparent or semitransparent, the other member is made to be a dark color such as black, and laser irradiation is carried out from the transparent or semitransparent member side. Thereby, the surface portion of the dark color member in the contacting part of both members is melted according to the laser irradiation. At the same time, the surface portion of the transparent or semitransparent member in the contacting part of both members is also welded and the interface therebetween is mixed and welded. When protective sheet 20 is a resin sheet of black or dark color, transparent resin is used for protrusion member 25, and laser irradiation may be carried out from the lower surface side of protrusion member 25. When protective sheet 20 is a transparent or semitransparent resin sheet, resin of black or dark color is used for protrusion member 25, and laser irradiation may be carried out from the upper surface side of protective sheet 20.

Protrusion member 25 welded on the lower surface of protective sheet 20 is placed on the upper surface of movable contact 35. Therefore, the center portion of protective sheet 20 is raised by protrusion member 25. That is to say, protective sheet 20 is formed in a truncated cone shape in which the raised portion is an upper base whose diameter corresponds to the diameter of protrusion member 25 and a lower base is larger than the upper base. The periphery of protective sheet 20 is mounted on the upper end of case 31. The inclined surface of the truncated cone may slightly sag downward, and the truncated cone part is formed as protrusion portion 30.

Note here that a method for mounting protective sheet 20 on case 31 is not particularly limited, but in this embodiment, adhesive layer 23 is formed on only the periphery of the lower surface of protective sheet 20, and protective sheet 20 is fixed to the upper end of case 31 with adhesive layer 23.

As mentioned above, when protrusion portion 30 formed in a truncated cone shape is used, it is less likely that protective sheet 20 is unnecessarily stretched and excessive reaction force is generated during pressing operation with respect to protrusion portion 30. In addition, air below mobile contact 35, which is compressed by pressing operation, enters space 60 between the side surface of protrusion member 25 and protective sheet 20. Thereby, the feel is inhibited from becoming dull due to the compressed air, and an excellent operational feeling can be obtained.

Furthermore, since protective sheet 20 and protrusion member 25 are firmly fixed as a unit by welding, even if a pressing operation is repeated, they are not separated from each other. Furthermore, plastic deformation processing of protective sheet 20 into a shape of protrusion portion, which was necessary in a conventional method, is not required, and man-hour, control, or the like, related to the processing can be simplified. Since a configuration may be employed in which movable contact 35 is directly pushed in with a diameter of protrusion member 25 itself can be employed, an excellent operational feeling can be obtained.

Next, an operation of the push switch is described. When an operation button (not shown) at an electronic apparatus side is operated to be depressed, protrusion portion 30 is depressed by the lower surface of the operation button, and force is applied to movable contact 35 via protrusion portion 30. When the force exceeds a predetermined size, the center portion of movable contact 35 is reversed with a click feeling, and the lower surface of the center portion of movable contact 35 is brought into contact with center contact 32. Center contact 32 and outer contacts 34 are electrically connected to each other via movable contact 35, thus bringing first terminal 32A and second terminal 34A into electrical conduction. When the force is removed, movable contact 35 self-returns to its original shape by resilient force of itself, and first terminal 32A and second terminal 34A return to a state before the operation in which they are electrically independent from each other.

As mentioned above, protrusion member 25 itself applies depressing force to the center portion of movable contact 35 so as to operate movable contact 35. Therefore, by allowing the diameter of the lower surface of protrusion member 25 that depresses the upper surface of movable contact 35 to be a predetermined diameter suitable for the mounted movable contact 35, an excellent operational feeling can be obtained.

Note here that in addition to forming protective sheet 20 in a truncated cone shape, the side surface of protrusion member 25 may be welded on protective sheet 20. By allowing the side surface of protrusion member 25 to be welded on protective sheet 20, the strength is increased although the operational feeling is slightly reduced. Alternatively, for example, by allowing the side surface of protrusion member 25 to be adhesively attached to or adhesively fixed to protective sheet 20, protective sheet 20 may be along the outer shape of protrusion member 25.

In this embodiment, for protective sheet 20 and protrusion member 25, nylon is used, but polyphenylene sulfide (PPS), thermoplastic polyimide, or the like, may be used. However, it is preferable that protective sheet 20 and protrusion member 25 are formed of the same materials because welding can be securely carried out.

Second Embodiment

Figure 3:
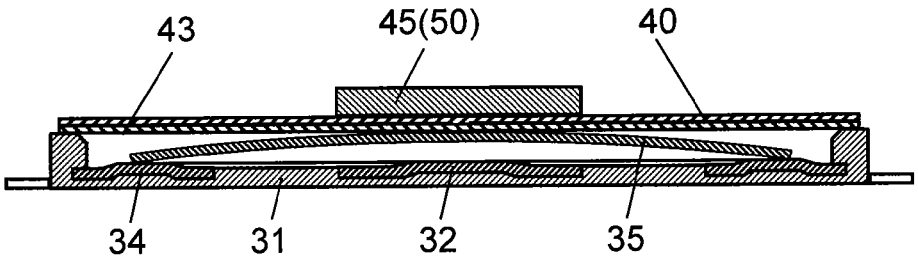
FIG. 3 is a sectional view of a push switch in accordance with a second embodiment of the present invention.
Figure 4:
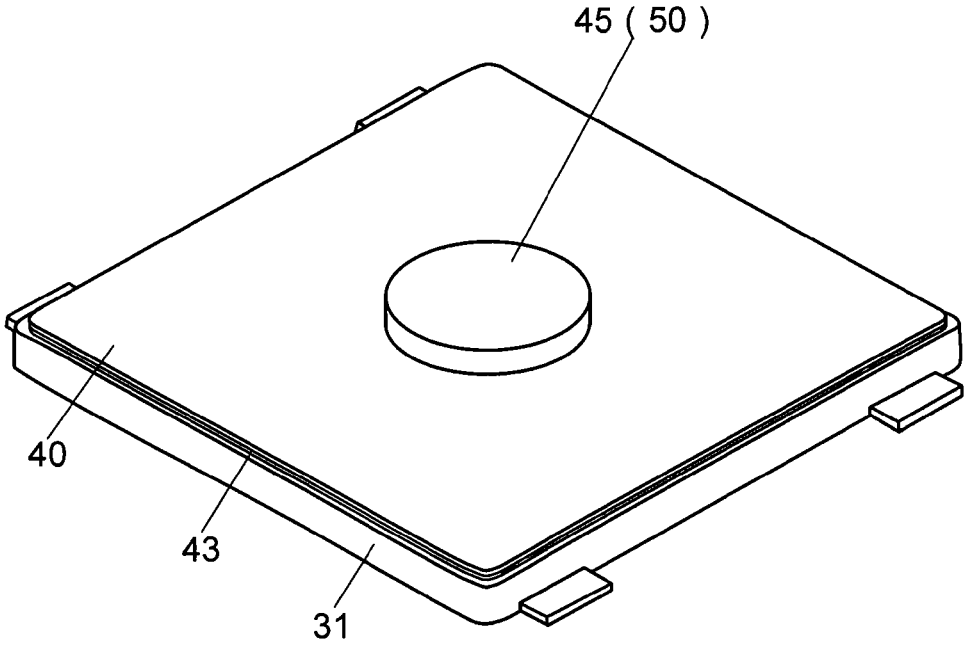
FIG. 4 is an external perspective view of the push switch in accordance with the second embodiment of the present invention.
Figure 5:
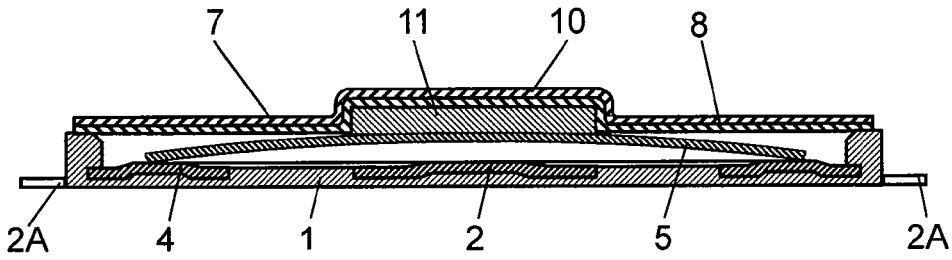
FIG. 5 PRIOR ART
FIG. 5 is an external perspective view of a conventional push switch.
Figure 6:
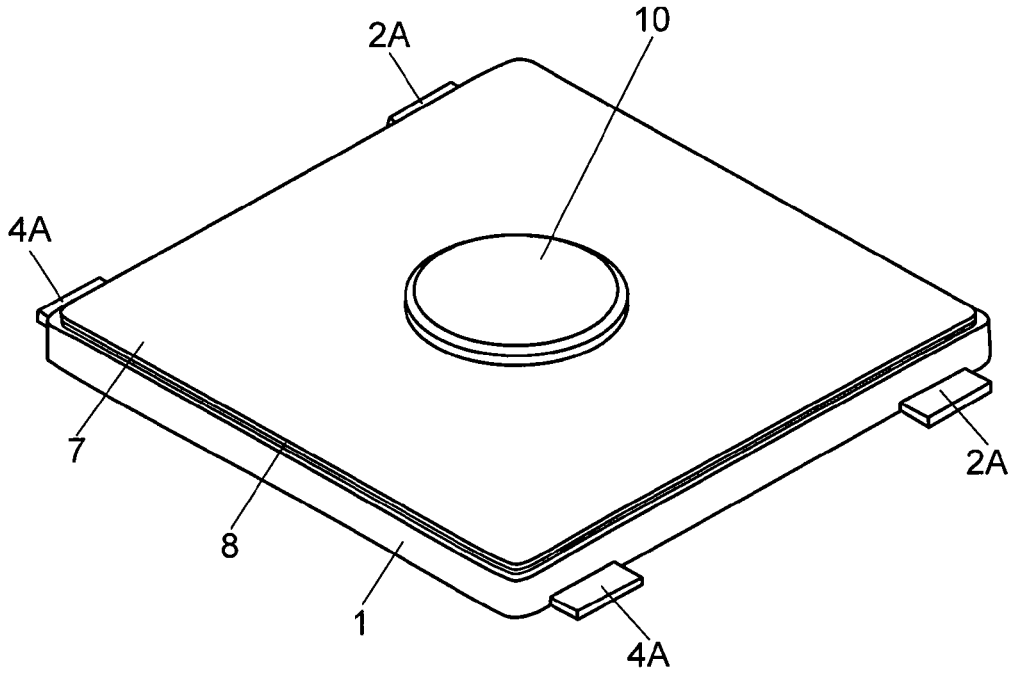
FIG. 6 PRIOR ART
FIG. 6 is an external perspective view of the conventional push switch.

FIG. 3 is a sectional view of a push switch in accordance with a second embodiment of the present invention. FIG. 4 is an external perspective view of the push switch in accordance with the second embodiment of the present invention.

The push switch of the second embodiment is different from the push switch of the first embodiment in a position in which protrusion member 45 is disposed. That is to say, protrusion member 45 is fixed by welding on a surface opposite to a surface facing movable contact 35 on protective sheet 40. Note here that the same reference numerals are given to configuration members that are the same as those in the first embodiment, and the detailed description thereof is omitted.

On the upper end of case 31 accommodating movable contact 35, protective sheet 40 covering a recess portion of case 31 is mounted. Protrusion member 45 is welded on the upper surface side of protective sheet 40, and protrusion member 45 is exposed. Protrusion member 45 is provided above the center of movable contact 35. That is to say, protrusion member 45 itself is formed as protrusion portion 50.

Note here that since a method for welding protrusion member 45 to protective sheet 40, and a method for selecting materials of protective sheet 40 and protrusion member 45 are the same as those in the first embodiment, the description thereof is omitted. Furthermore, a method for mounting protective sheet 40 on the upper end of case 31 is not particularly limited, but in this embodiment, protective sheet 40 is attached to the upper end of case 31 with adhesive layer 43 formed on the entire lower surface of protective sheet 40.

When the upper surface of the exposed protrusion member 45, that is, the upper surface of protrusion portion 50 is depressed, the depressing force is applied to the center portion of movable contact 35 via protective sheet 40. When the force exceeds predetermined force, the center portion of movable contact 35 is reversed with a click feeling as in the first embodiment, so that the lower surface of the center portion of movable contact 35 is brought into contact with center contact 32. Center contact 32 and outer contacts 34 are brought into electrical conduction via movable contact 35. When the depressing force is released, the reversed movable contact 35 returns by itself to the original upwardly convex shape, returning force of protective sheet 40 is also added, and then the state returns to an original switching off state.

As mentioned above, in this configuration, protrusion member 45 as protrusion portion 50 is fixed by welding to the upper surface of protective sheet 40 and is exposed. Since protrusion member 45 is firmly fixed, even if depressing operation of protrusion member 45 is repeated over a long period of time, protrusion member 45 is not peeled off from the upper surface of protective sheet 40.

In the above-mentioned configuration, since plastic deformation processing of protective sheet 40 into a shape of protrusion portion, which was necessary in conventional products, is not required at all, man-hour, control, or the like, related to the processing can be omitted. Furthermore, since the lower surface of protrusion member 45 and the upper surface of protective sheet 40 are fixed as a unit by welding, an application process of an adhesive agent, control of an application amount, or the like, is not required. Therefore, the push switch of this configuration can be manufactured with less man-hour.

As mentioned above, the present invention is described with reference to two embodiments, however center contact 32, outer contact 34, movable contact 35, and the like, are not limited to the above-mentioned configurations. Any configurations may be employed as long as center contact 32 and outer contacts 34 are provided on the internal bottom surface of the recess portion of case 31 in such positions in which center contact 32 and outer contacts 34 are electrically connected to each other via movable contact 35 when movable contact 35 is reversed. That is to say, as long as center contact 32 and outer contacts 34 are provided on the internal bottom surface of the recess portion of case 31 in positions in which movable contact 35 is placed, the shape is not particularly limited. For example, a configuration may be employed in which center contact 32 and outer contacts 34 are placed in the vicinity of the position corresponding to the center of movable contact 35, and when movable contact 35 is reversed, center contact 32 and outer contacts 34 are electrically connected by the center portion of movable contact 35.

Since the push switch of this embodiment is not subjected to pressing and the like during manufacturing of protrusion portion 50, it is not necessary to finely adjust the pressing conditions such as temperature and time. Therefore, the push switch of this embodiment can be manufactured with a simpler method than conventional methods, and therefore, is useful mainly in input operation portions of electronic apparatuses.

What is claimed is:

1. A push switch, comprising:

a case having a bottom and an outer wall surrounding the bottom to form a recess portion;

a first fixed contact placed on the bottom of the case;

a second fixed contact placed on the bottom of the case;

a dome-shaped movable contact placed in the recess portion and having a center portion facing the first fixed contact with a space therebetween;

a protective sheet covering the recess portion; and a protrusion member fixed to the protective sheet at a convex side of the center portion of the movable contact, and placed between the protective sheet and the movable contact, the protrusion member and the protective sheet are melted together at an interface therebetween, wherein the first fixed contact and the second fixed contact are provided at positions where they are brought into contact with the movable contact when the movable contact is elastically reversed, wherein the protrusion member includes a top surface and a side surface, the side surface is not fixed to the protective sheet, a space is provided between the side surface and the protective sheet so that the space is capable of receiving air between the movable contact and an inner bottom face of the case when the movable contact is elastically reversed, wherein a periphery of the dome-shaped movable contact is in contact with the inner bottom face of the case before the movable contact is elastically reversed, so that the periphery of the dome-shaped movable contact is apart from the protective sheet at a distance of a height of the outer wall in the recess portion, and wherein a height of a top of the convex side of the center portion of the movable contact in the recess portion is substantially equal to the height of the outer wall in the recess portion, so that a) a portion of the protective sheet in contact with the protrusion member; and b) a portion of the protrusion member, project beyond the outer wall of the case.

2. The push switch of claim 1, wherein the protrusion member is formed in a columnar shape, and the protective sheet is raised by the protrusion member to be formed in a truncated cone shape, where a diameter of an upper base of the truncated cone shape corresponds to a diameter of the protrusion member and a lower base of the truncated cone is larger than the upper base.

3. The push switch of claim 1, wherein the protrusion member and the protective sheet are formed of the same material.

4. The push switch of claim 1, wherein the protective sheet and the protrusion member are mixed with each other at an interface portion between the protective sheet and the protrusion member.

5. The push switch of claim 1, wherein the protrusion member includes a top surface and a side surface, the top surface is fixed to the protective sheet without any adhesive layer therebetween.

6. The push switch of claim 1, wherein the protrusion member includes a top surface and a side surface, the top surface is directly in contact with the protective sheet.

7. The push switch of claim 1, wherein the protective sheet is attached to an upper end of the outer wall of the case with an adhesive layer.

8. The push switch of claim 1, wherein colors of the protective sheet and the protrusion member are different from each other.

9. The push switch of claim 8, wherein one of the protective sheet and the protrusion member is transparent or semitransparent and the other of the protective sheet and the protrusion member is opaque.

10. A method for manufacturing a push switch, the method comprising:

placing a first fixed contact on a bottom of a case having the bottom and an outer wall surrounding the bottom to form a recess portion;

placing a second fixed contact on the bottom of the case;

placing a dome-shaped movable contact having a center portion facing the first fixed contact with a space therebetween in the recess portion;

placing a protective sheet so as to cover the recess portion; and fixing a protrusion member to the protective sheet by welding at a convex side of the center portion of the movable contact after placing the protrusion member between the protective sheet and the movable contact, so that the protrusion member and the protective sheet are melted together at the interface therebetween, wherein the protrusion member includes a top surface and a side surface, at fixing the protrusion member to the protective sheet, the side surface is not fixed to the protective sheet, a space is provided between the side surface and the protective sheet so that the space is capable of receiving air between the movable contact and an inner bottom face of the case when the movable contact is elastically reversed, wherein a periphery of the dome-shaped movable contact is in contact with the bottom of the case before the movable contact is elastically reversed, so that the periphery of the dome-shaped movable contact is apart from the protective sheet at a distance of a height of the outer wall in the recess portion, and wherein a height of a top of the convex side of the center portion of the movable contact in the recess portion is substantially equal to the height of the outer wall in the recess portion, so that a) a portion of the protective sheet in contact with the protrusion member; and b) a portion of the protrusion member, project beyond the outer wall of the case.

11. The method for manufacturing a push switch of claim 10, wherein when the protrusion member is fixed to the protective sheet, laser irradiation is carried out to a top surface of the protective sheet or a top surface of the protrusion member.

* * * * *